US010849448B1

(12) United States Patent
Bland

(10) Patent No.: US 10,849,448 B1
(45) Date of Patent: Dec. 1, 2020

(54) RACK FOR HATS AND EYEGLASSES

(71) Applicant: Meledey Bland, Ocala, FL (US)

(72) Inventor: Meledey Bland, Ocala, FL (US)

( * ) Notice: Subject to any disclaimer, the term of this patent is extended or adjusted under 35 U.S.C. 154(b) by 0 days.

(21) Appl. No.: 16/934,087

(22) Filed: Jul. 21, 2020

(51) Int. Cl.

| | |
|---|---|
| ***A47G 25/10*** | (2006.01) |
| ***A47F 7/06*** | (2006.01) |
| ***A47F 7/02*** | (2006.01) |
| *A47F 5/00* | (2006.01) |
| *A47F 5/04* | (2006.01) |

(52) U.S. Cl.
CPC ..... *A47G 25/10* (2013.01); *A47F 7/021* (2013.01); *A47F 7/06* (2013.01); *A47F 5/00* (2013.01); *A47F 5/04* (2013.01)

(58) Field of Classification Search
CPC .... A47F 7/06; A47F 7/021; A47F 5/00; A47F 5/04; A47F 5/01; A47F 7/0243; A47F 5/13; A47G 25/10; A47G 25/0664
USPC ..... 211/85.1, 30, 33, 133.1, 133.2, 133.4, 211/133.5, 205
See application file for complete search history.

(56) References Cited

U.S. PATENT DOCUMENTS

| | | | | | |
|---|---|---|---|---|---|
| 726,527 | A * | 4/1903 | Hager | A47G 25/10 | 211/30 |
| 918,196 | A * | 4/1909 | Price | A47F 7/163 | 211/45 |
| 1,747,951 | A | 2/1930 | Reichert | | |
| 1,980,587 | A * | 11/1934 | Hayes | G03F 1/90 | 276/1 |
| 2,010,093 | A | 8/1935 | Lazarus | | |
| 2,213,677 | A | 9/1940 | Miller | | |
| 2,704,176 | A | 3/1955 | Smith | | |
| 2,713,947 | A | 7/1955 | Foster | | |
| 3,195,731 | A * | 7/1965 | Bomar, Jr. | A47F 7/021 | 211/85.1 |
| 4,039,082 | A * | 8/1977 | Ladinsky | A47B 63/00 | 211/45 |
| 4,491,256 | A | 1/1985 | Payne | | |
| 4,708,271 | A | 11/1987 | Grommes | | |
| D369,910 | S | 5/1996 | McCarty | | |
| 5,568,872 | A * | 10/1996 | Hinnant, Sr. | A47F 7/021 | 211/85.1 |
| 6,182,838 | B1 * | 2/2001 | Hodson | A47G 25/0664 | 211/70.6 |
| 6,968,985 | B1 | 11/2005 | Caccavallo | | |
| 2014/0263110 | A1 * | 9/2014 | Erickson | A47G 25/746 | 211/32 |

* cited by examiner

*Primary Examiner* — Jonathan Liu
*Assistant Examiner* — Devin K Barnett
(74) *Attorney, Agent, or Firm* — Kyle A. Fletcher, Esq.

(57) ABSTRACT

The rack for hats and eyeglasses comprises a plurality of hat clips, a plurality of eyewear holders, a support frame, and a base. The rack for hats and eyeglasses may be a display stand and organizer for one or more pairs of eyeglasses and one or more hats. The plurality of hat clips and the plurality of eyewear holders may be elevated above the base such that the one or more pairs of eyeglasses and the one or more hats may be displayed for selection. The rack for hats and eyeglasses may reduce a footprint required to store the one or more pairs of eyeglasses and the one or more hats when compared to the footprint that would be required to place the one or more pairs of eyeglasses and the one or more hats on a counter top or another horizontal surface.

19 Claims, 4 Drawing Sheets

RACK FOR HATS AND EYEGLASSES

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of accessory display stands, more specifically, a rack for hats and eyeglasses.

SUMMARY OF INVENTION

The rack for hats and eyeglasses comprises a plurality of hat clips, a plurality of eyewear holders, a support frame, and a base. The rack for hats and eyeglasses may be a display stand and organizer for one or more pairs of eyeglasses and one or more hats. The plurality of hat clips and the plurality of eyewear holders may be elevated above the base such that the one or more pairs of eyeglasses and the one or more hats may be displayed for selection. The rack for hats and eyeglasses may reduce a footprint required to store the one or more pairs of eyeglasses and the one or more hats when compared to the footprint that would be required to place the one or more pairs of eyeglasses and the one or more hats on a counter top or another horizontal surface.

An object of the invention is to store and display a plurality of hats.

Another object of the invention is to store and display a plurality of eyeglasses.

A further object of the invention is to retain the plurality of hats above a base using a plurality of hat clips that are coupled to a support frame.

Yet another object of the invention is to support the individual pairs of eyeglasses on a cantilever of a beam that is coupled to s support frame.

These together with additional objects, features and advantages of the rack for hats and eyeglasses will be readily apparent to those of ordinary skill in the art upon reading the following detailed description of the presently preferred, but nonetheless illustrative, embodiments when taken in conjunction with the accompanying drawings.

In this respect, before explaining the current embodiments of the rack for hats and eyeglasses in detail, it is to be understood that the rack for hats and eyeglasses is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the rack for hats and eyeglasses.

It is therefore important that the claims be regarded as including such equivalent construction insofar as they do not depart from the spirit and scope of the rack for hats and eyeglasses. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description. As used herein, the word "or" is intended to be inclusive.

Figure 1:
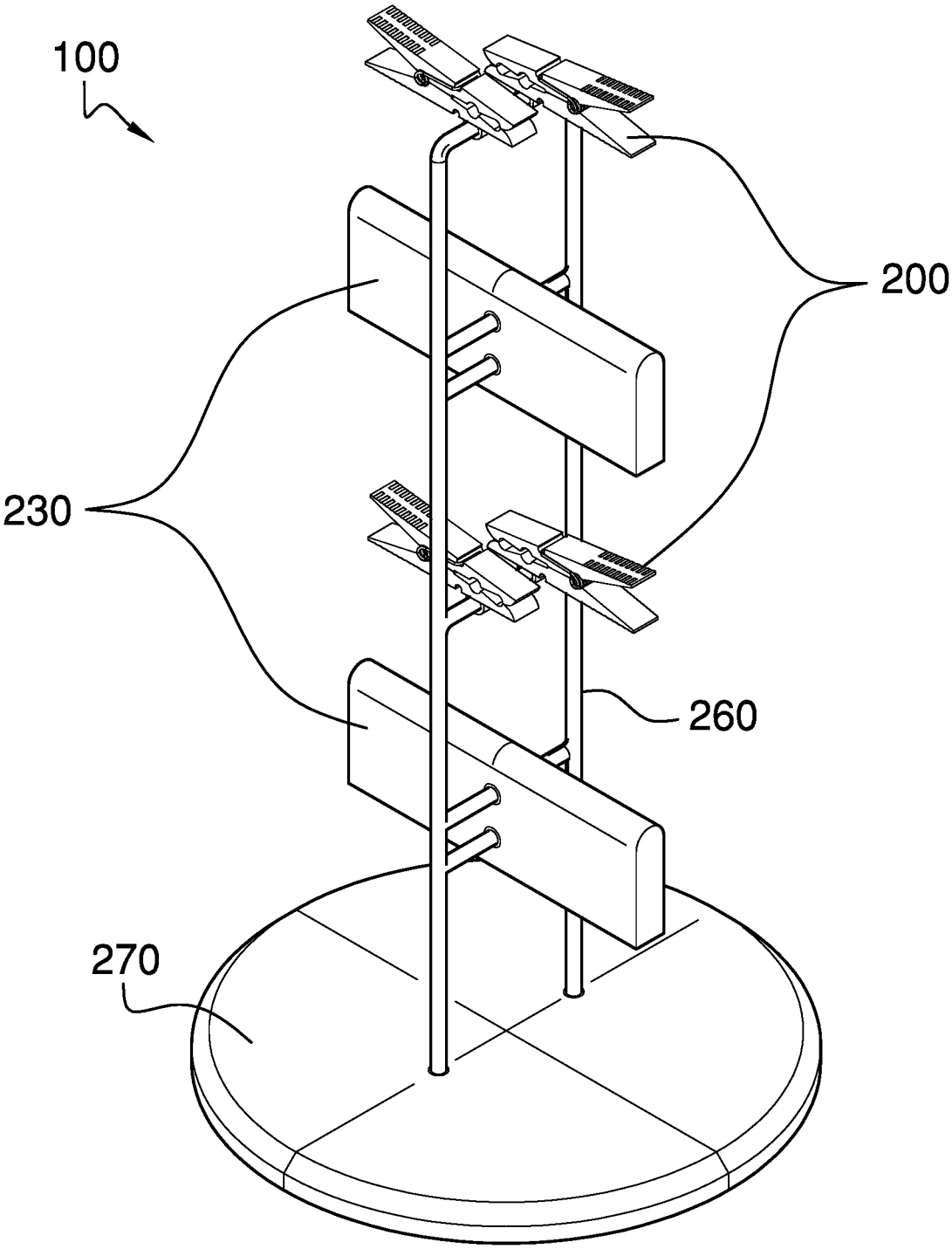
FIG. 1 is an isometric view of an embodiment of the disclosure.
Figure 2:
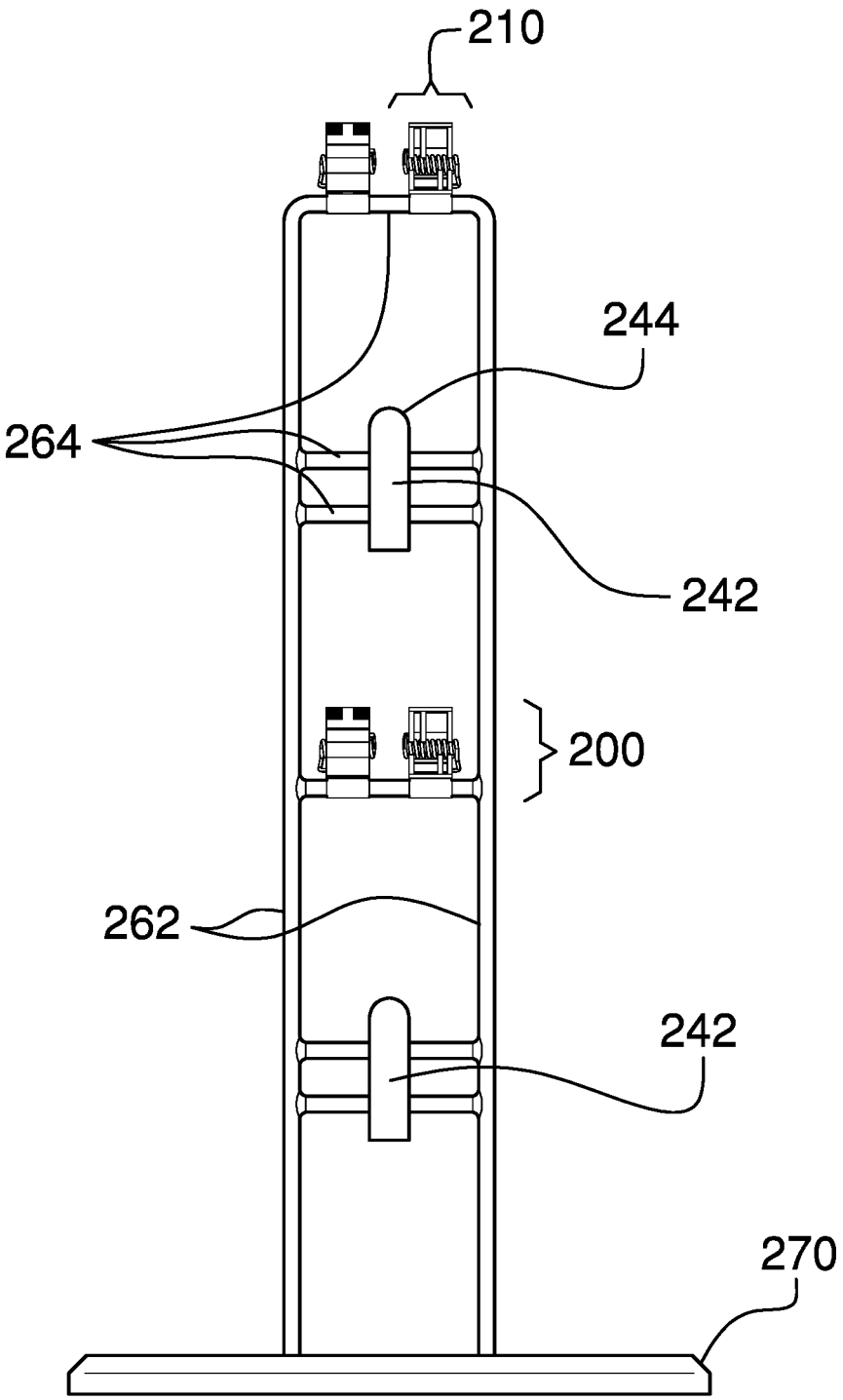
FIG. 2 is a front view of an embodiment of the disclosure.
Figure 3:
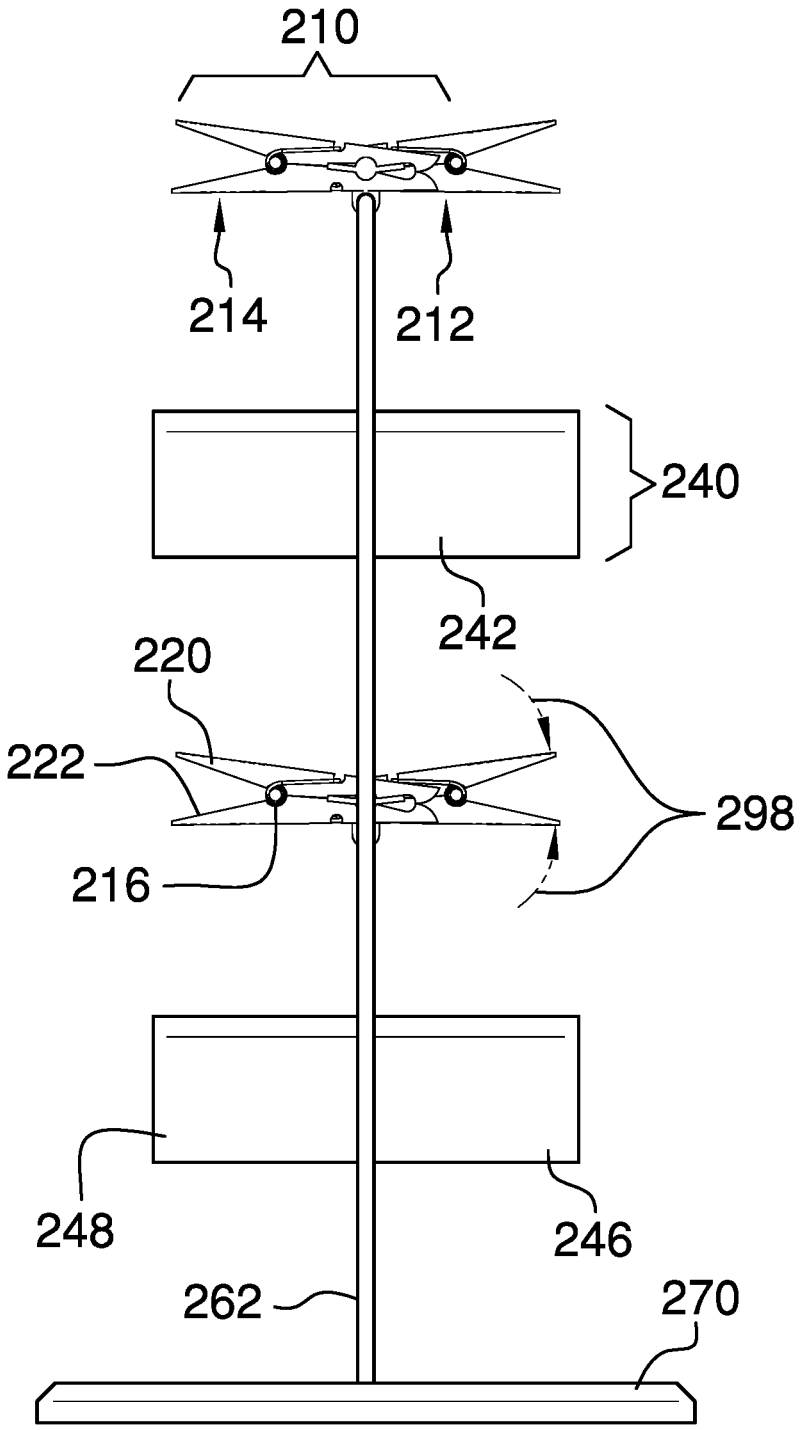
FIG. 3 is a side view of an embodiment of the disclosure.
Figure 4:
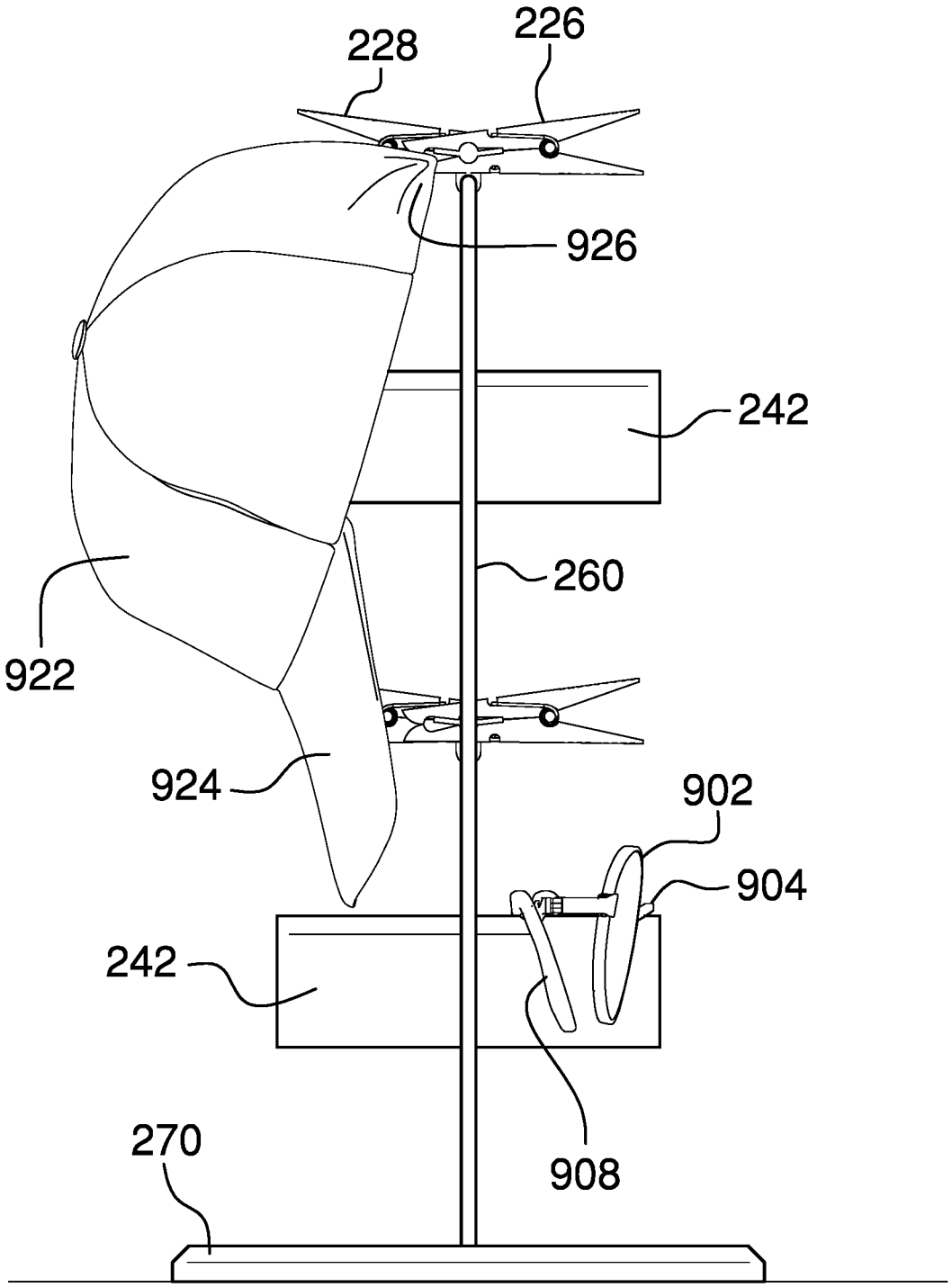
FIG. 4 is an in-use view of an embodiment of the disclosure.

Detailed reference will now be made to a first potential embodiment of the disclosure, which is illustrated in FIGS. 1 through 4.

The rack for hats and eyeglasses 100 (hereinafter invention) comprises a plurality of hat clips 100, a plurality of eyewear holders 230, a support frame 260, and a base 270. The invention 100 may be a display stand and organizer for one or more pairs of eyeglasses and one or more hats. The plurality of hat clips 200 and the plurality of eyewear holders 230 may be elevated above the base 270 such that the one or more pairs of eyeglasses and the one or more hats may be displayed for selection. The invention 100 may reduce a footprint required to store the one or more pairs of eyeglasses and the one or more hats when compared to the footprint that would be required to place the one or more pairs of eyeglasses and the one or more hats on a counter top or another horizontal surface. As non-limiting examples, the one or more pairs of eyeglasses may be prescriptive glasses, sunglasses, or combinations thereof. As non-limiting examples, the one or more hats may be baseball caps, sun hats, a fishing hats, newsboys, or combinations thereof.

The plurality of hat clips 200 may removably couple to the one or more hats to retain the one or more hats for display. As non-limiting examples, an individual hat clip 210 may couple to a visor 924, a brim, or a backstrap 926 of an individual hat 922. The plurality of hat clips 200 may be coupled to a plurality of horizontal armatures 264 of the support frame 260. The plurality of hat clips 200 may be dispersed on the support frame 260 at two or more heights above the base 270. In some embodiments, two of the plurality of hat clips 200 at the same height may be oriented in opposite horizontal directions. As a non-limiting example, a first hat clip 226 at a given height may be oriented to accept a first hat from the one side of the invention 100 and a second hat clip 228, at the same height as the first hat clip 226, may be oriented to accept a second hat from the opposing side of the invention 100.

The individual hat clip 210 may be defined by a grasping end 212 and a squeezing end 214. The individual hat clip 210 may be squeezed at the squeezing end 214 to open the grasping end 212. The individual hat 922 may be placed within the grasping end 212 and the squeezing end 214 may be released to retain the individual hat 922 in the grasping end 212. The individual hat clip 210 may comprise an upper paddle 220, a lower paddle 222, and a spring 216. The upper paddle 220 and the lower paddle 222 may be pivotably coupled to each other at a midpoint by the spring 216 such that the upper paddle 220 and the lower paddle 222 are held adjacent to each other at the grasping end 212. The upper paddle 220 and the lower paddle 222 may be operable to pivot around the spring 216 when the squeezing end 214 is compressed by an external compressing force 298, thus causing the grasping end 212 to open. The spring 216 may cause the upper paddle 220 and the lower paddle 222 to pivot such that the grasping end 212 closes when the external compressing force 298 is removed.

The plurality of eyewear holders 230 may support the one or more pairs of eyeglasses for display. The plurality of eyewear holders 230 may be coupled to the plurality of horizontal armatures 264 of the support frame 260. The plurality of eyewear holders 230 may be dispersed on the support frame 260 at two or more heights above the base 270.

An individual eyewear holder 240 may comprise a beam 242 having a rounded top edge 244. The beam 242 may be horizontally oriented and may define a first cantilever 246 and a second cantilever 248. The first cantilever 246 and the second cantilever 248 may be the opposing ends of the beam 242. The one or more pairs of eyeglasses may be stored on the first cantilever 246, on the second cantilever 248, or both. An individual pair of eyeglasses 902 may be stored by placing a bridge 904 of the individual pair of eyeglasses 902 onto the rounded top edge 244 of the beam 242 above the first cantilever 246 or above the second cantilever 248. In some embodiments, temples 908 of the individual pair of eyeglasses 902 may be opened and rested on the plurality of horizontal armatures 264 that support the beam 242. In some embodiments, the beam 242 may be fully or partially padded to minimize the risk of scratching the one or more pairs of eyeglasses. As non-limiting examples, the beam 242 may be covered with a fabric such as felt or the beam 242 may be flocked with fiber particles.

The support frame 260 may elevate the plurality of hat clips 200 and the plurality of eyewear holders 230 above the base 270 such that the plurality of hat clips 200 and the plurality of eyewear holders 230 are contained within the footprint of the base 270. The support frame 260 may comprise one or more vertical armatures 262 and the plurality of horizontal armatures 264. The bottom of the one or more vertical armatures 262 may be coupled to the base 270. The one or more vertical armatures 262 may extend upward to the height of the uppermost of the plurality of hat clips 200 or the uppermost of the plurality of eyewear holders 230. In a preferred embodiment, there may be two vertical armatures and the two vertical armatures may be parallel to each other.

The plurality of horizontal armatures 264 may support the plurality of hat clips 200 and the plurality of eyewear holders 230. The plurality of horizontal armatures 264 may be coupled to the one or more vertical armatures 262.

The base 270 may be a stand for the invention 100 and may stabilize the invention 100. The base 270 may define the footprint of the invention 100. In a preferred embodiment, the base 270 may be circular. In some embodiments, the invention 100 may intersperse the plurality of hat clips 200 and the plurality of eyewear holders 230 such that the plurality of hat clips 200 alternate with the plurality of eyewear holders 230 at successive heights up the support frame 260. In a preferred embodiment, there may be two heights comprising the individual eyewear holders 240 and two heights comprising the individual hat clips 210.

In use, the invention 100 may be placed on a counter, night stand, bureau, or another horizontal surface. An individual hat 922 may be stored on the invention 100 by squeezing a squeezing end 214 of an individual hat clip 210, placing some portion of the individual hat 922 into a grasping end 212 of the individual hat clip 210, and releasing the squeezing end 214 of the individual hat clip 210. An individual pair of eyeglasses 902 may be stored on the invention 100 by placing a bridge 904 of the individual pair of eyeglasses 902 on a first cantilever 246 or a second cantilever 248 of a beam 242 and, in some embodiments, resting temples 908 of the individual pair of eyeglasses 902 on a plurality of horizontal armatures 264 that support the beam 242.

Definitions

Unless otherwise stated, the words "up", "down", "top", "bottom", "upper", and "lower" should be interpreted within a gravitational framework. "Down" is the direction that gravity would pull an object. "Up" is the opposite of "down". "Bottom" is the part of an object that is down farther than any other part of the object. "Top" is the part of an object that is up farther than any other part of the object. "Upper" may refer to top and "lower" may refer to the bottom. As a non-limiting example, the upper end of a vertical shaft is the top end of the vertical shaft.

As used in this disclosure, a "cantilever" may be a beam or other structure that projects away from an object and is supported on only one end. A cantilever is further defined with a fixed end and a free end. The fixed end is the end of the cantilever that is attached to the object. The free end is the end of the cantilever that is distal from the fixed end.

As used herein, "clip" may refer to a fastener that attaches to an object by gripping or clasping the object. A clip may be spring loaded.

As used herein, the words "couple", "couples", "coupled" or "coupling", may refer to connecting, either directly or indirectly, and does not necessarily imply a mechanical connection.

As used here, "footprint" may refer to a vertical, downward projection of an object onto the surface that supports the object. The portion of the supporting surface that is within the footprint is, by definition, underneath the object.

As used in this disclosure, "horizontal" may be a directional term that refers to a direction that is perpendicular to the local force of gravity. Unless specifically noted in this disclosure, the horizontal direction is always perpendicular to the vertical direction.

As used here, the word "midpoint" may refer to a point that is between the ends of an object. An "exact midpoint" may refer to a midpoint that is equidistant from edges of the object in at least one direction. Unless otherwise stated, a midpoint is not required to be at the exact center of the object but instead may be within 50% of the distance from the exact midpoint to the farthest edge, farthest end, or farthest corner.

As used herein, the word "pivot" may include any mechanical arrangement that allows for rotational motion. Non-limiting examples of pivots may include hinges, holes, posts, dowels, pins, points, rods, shafts, balls, and sockets, either individually or in combination.

As used in this disclosure, the term "rounded" may refer to the replacement of an apex, vertex, or edge or brink of a structure with a (generally smooth) curvature wherein the concave portion of the curvature faces the interior or center of the structure.

As used in this disclosure, a "spring" may be a device that is used to store mechanical energy. This mechanical energy will often be stored by deforming an elastomeric material that is used to make the device, by the application of a torque to a rigid structure, or by a combination thereof. In some embodiments, the rigid structure to which torque is applied may be composed of metal or plastic.

As used in this disclosure, "vertical" may refer to a direction that is parallel to the local force of gravity. Unless specifically noted in this disclosure, the vertical direction is always perpendicular to horizontal.

With respect to the above description, it is to be realized that the optimum dimensional relationship for the various components of the invention described above and in FIGS. 1 through 4, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A rack for hats and eyeglasses comprising:

an inverted U-shaped support frame having a pair of legs and a top armature;

a plurality of horizontal armatures extending between the pair of legs;

wherein the pair of legs extend upwardly from a base that is configured to rest upon a support surface;

a plurality of elongated clips attached to at least one of the horizontal armatures and extending parallel relative to the base, the elongated clips configured to suspend one or more hats therefrom;

a plurality of eyewear holder beams configured to support one or more eyeglasses, wherein corresponding horizontal armatures extend through the eyewear holder beams, wherein the eyewear holder beams are transverse relative to the corresponding horizontal armatures;

wherein the plurality of elongated clips and the plurality of eyewear holder beams are elevated above the base such that one or more pairs of eyeglasses and the one or more hats are displayed for selection.

2. The rack for hats and eyeglasses according to claim 1, wherein the plurality of elongated clips removably couple to the one or more hats to retain the one or more hats for display.

3. The rack for hats and eyeglasses according to claim 2, wherein the plurality of elongated clips are dispersed on the support frame at two or more heights above the base.

4. The rack for hats and eyeglasses according to claim 3, wherein two of the plurality of elongated clips are located at the same height and are oriented in opposite horizontal directions.

5. The rack for hats and eyeglasses according to claim 3, wherein each elongated clip is defined by a grasping end and a squeezing end;

wherein the each elongated clip is configured to be squeezed at the squeezing end to open the grasping end;

wherein an individual hat from said one or more hats is placed within the grasping end of a corresponding elongated clip and the squeezing end of the corresponding elongated clip is released to retain the individual hat in the grasping end of the corresponding elongated clip.

6. The rack for hats and eyeglasses according to claim 5, wherein each elongated clip comprises an upper paddle, a lower paddle, and a spring;

wherein the upper paddle and the lower paddle are pivotably coupled to each other at a midpoint by the spring such that the upper paddle and the lower paddle are held adjacent to each other at the grasping end;

wherein the upper paddle and the lower paddle are operable to pivot around the spring when the squeezing end is compressed by an external compressing force, thus causing the grasping end to open;

wherein the spring causes the upper paddle and the lower paddle to pivot such that the grasping end closes when the external compressing force is removed.

7. The rack for hats and eyeglasses according to claim 6, wherein the plurality of eyewear holder beams support the one or more pairs of eyeglasses for display.

8. The rack for hats and eyeglasses according to claim 7, wherein the plurality of eyewear holder beams are dispersed on the rack at two or more heights above the base.

9. The rack for hats and eyeglasses according to claim 8, wherein each eyewear holder beam has a rounded top edge;

wherein each beam is horizontally oriented and defines a first end and a second end;

wherein the first end and the second end are opposing ends of the beam;

wherein the one or more pairs of eyeglasses are stored on the first end, on the second end, or both.

10. The rack for hats and eyeglasses according to claim 9, wherein an individual pair of eyeglasses is stored by placing a bridge of the individual pair of eyeglasses onto the rounded top edge of a corresponding beam above the first end or above the second end of the corresponding beam.

11. The rack for hats and eyeglasses according to claim 10, wherein temples of the individual pair of eyeglasses are opened and rested on a corresponding horizontal armature that support the corresponding beam.

12. The rack for hats and eyeglasses according to claim 10, wherein each beam is fully or partially padded to minimize the risk of scratching the one or more pairs of eyeglasses.

13. The rack for hats and eyeglasses according to claim 12,
wherein each beam is covered with a fabric or each beam is flocked with fiber particles.

14. The rack for hats and eyeglasses according to claim 1, wherein pair of legs are parallel to each other.

15. The rack for hats and eyeglasses according to claim 14 wherein the plurality of horizontal armatures support corresponding elongated clips and the plurality of eyewear holders.

16. The rack for hats and eyeglasses according to claim 15,
wherein the base is a stand for the rack and stabilizes the rack.

17. The rack for hats and eyeglasses according to claim 16,
wherein the base is circular.

18. The rack for hats and eyeglasses according to claim 16,
wherein the rack intersperses the plurality of elongated clips and the plurality of eyewear holder beams such that the plurality of elongated clips alternate with the plurality of eyewear holder beams at successive heights along the rack.

19. The rack for hats and eyeglasses according to claim 18,
wherein there are two heights comprising corresponding eyewear holder beams and two heights comprising the elongated clips.

* * * * *